US005605186A

United States Patent [19]

Dusablon et al.

[11] Patent Number: 5,605,186

[45] Date of Patent: Feb. 25, 1997

[54] DIE-CASTING OF METALS WITH DISPERSION OF SOLID PARTICLES IN RESULTING CASTINGS

[75] Inventors: Andre Dusablon; Claude Berthiaume, both of Quebec, Canada

[73] Assignee: Institut de la technologie du magnesium (ITM), Quebec, Canada

[21] Appl. No.: 500,209

[22] Filed: Jul. 10, 1995

[51] Int. Cl.[6] ..... B22D 19/14; B22D 17/12

[52] U.S. Cl. ..... 164/97; 164/113

[58] Field of Search ..... 164/97, 113, 55.1, 164/56.1, 57.1, 58.1

[56] References Cited

U.S. PATENT DOCUMENTS 4,340,109 7/1982 Roddy .

5,390,723 2/1995 Mohla et al. ..... 164/57.1

FOREIGN PATENT DOCUMENTS 953078 8/1974 Canada .

*Primary Examiner*—Kuang Y. Lin

*Attorney, Agent, or Firm*—Keck, Mahin & Cate

[57] ABSTRACT

The invention provides a method of die-casting of metals, with dispersion of predetermined quantities of solid particles in resulting metal castings. This is achieved by inserting a cartridge into the runner system, which cartridge is normally sealed at both ends with foil and contains the predetermined quantity of the solid particles. When molten metal is injected through the runner system and thus through the cartridge, it entrains the solid particles therewith which are thereby intermixed with the molten metal and form the composite material of which the die-cast part is thus made. The cartridge is preferably formed of the same metal as the one used for the die-casting, so that it may then be recycled.

25 Claims, 5 Drawing Sheets

DIE-CASTING OF METALS WITH DISPERSION OF SOLID PARTICLES IN RESULTING CASTINGS

BACKGROUND OF THE INVENTION

1. Field of the Invention

The present invention relates to a method of die-casting of metals with dispersion of predetermined quantities of solid particles in the resulting metal castings. More particularly, in a preferred embodiment, the invention relates to hot-chamber die-casting of metals, such as magnesium alloys, with dispersion therein of precisely measured quantities of solid particles.

2. Brief Description of the Prior Art

It is already known that solid additives may be incorporated into the molten metal during die-casting. For example, Canadian Patent No. 953,078 of Aug. 20, 1974 discloses such a method where an additive is supplied into the sleeve through which the molten metal is injected and is pushed into the runner and the cavity by said molten metal. However, this arrangement, makes it difficult to achieve a good dispersion of a predetermined quantity of solid particles in the resulting metal casting because the solid particles introduced as disclosed in this Canadian patent cannot be readily maintained in one place to be quickly combined and intermixed with the molten metal, but are rather spread by gravity within the sleeve into which they are introduced and must travel some distance with the liquid metal through the sleeve, then through the runner and finally into the cavity. Thus, there are usually serious problems of segregation and non-uniformity of dispersion encountered in such cases.

U.S. Pat. No. 4,340,109 of Jul. 20, 1982 also discloses a similar arrangement where a predetermined amount of a preheated filler material, such as sand, is placed in the shot sleeve leading to the runner and the die cavity and also a predetermined amount of molten metal alloy is placed in the same shot sleeve following the filler material and both are then forced through the runner into the die cavity to form a casting with the particular filler material intermixed with the molten metal. This method is not easy to implement. For example, solid particulate material will not readily stay in a nice neat pile as shown in this U.S. Patent. Also, the molten metal is normally injected or poured from metal containers, rather than being placed in a predetermined quantity beside the solid particles. Thus, the same problems as already described with reference to Canadian Patent No. 953,078 will arise. Also, if the molten metal is a reactive metal, such as magnesium, it may violently react with the solid particles being dispersed, producing undesirable residues or reaction products. This often happens when ceramic materials are placed in contact with molten magnesium for a sufficient period of time.

OBJECTS AND SUMMARY OF THE INVENTION

It is an object of the present invention to obviate the disadvantages of the prior art and to provide a simple and efficient method of dispersing predetermined quantities of solid particles in metal castings by placing said solid particles within a suitable cartridge through which the liquid metal is then injected.

Another object is to provide the solid particles right in the runner to the die so that they are intermixed with the molten metal very rapidly, for example in a fraction of a second.

A still further object is to provide the solid particles within a cartridge made of the same metal as the molten metal being injected into the die, so that the cartridge may then be recycled.

Other objects and advantages of the invention will become apparent from the following description thereof.

Thus, the present invention provides a method of die-casting of metals, with dispersion of predetermined quantities of solid particles in resulting metal castings, said metal castings being made by injection of a diecastable molten metal into a cavity formed between two halves of a die, a fixed half and a moving half, the injection of the molten metal into said cavity being effected through a runner leading into the cavity, said method comprising: inserting into said runner a cartridge containing a predetermined quantity of solid particles to be dispersed in a metal casting, said cartridge being sealed with foil at least at one end thereof so as to retain the solid particles within the cartridge; injecting a shot of the molten metal into the cavity through said cartridge, thereby piercing the foil sealing said cartridge and entraining the solid particles contained in said cartridge into the cavity while intermixing said particles with said molten metal; allowing said molten metal to solidify in the cavity to form the metal casting with the predetermined quantity of the solid particles dispersed therein; and moving the moving half of the die away from the fixed half to eject said casting from the cavity.

According to a preferred embodiment, the present invention provides a method of hot-chamber die-casting of metals, with dispersion of predetermined quantities of solid particles in resulting metal castings, said metal castings being made by injection of a diecastable molten metal into a cavity formed between two halves of a die, a fixed half and a moving half, the injection of the molten metal into said cavity being effected through a bore of a sprue bushing mounted in the fixed half of the die (i.e. the runner to the cavity), the novel method comprising: inserting into said bore a cartridge containing a predetermined quantity of solid particles to be dispersed in a metal casting, said cartridge being sealed with foil at least at one end thereof so as to retain the solid particles within the cartridge; injecting a shot of the molten metal into the cavity through said cartridge, thereby piercing the foil sealing said cartridge and entraining the solid particles into the cavity while intermixing said particles with said molten metal; allowing said molten metal to solidify in the cavity to form the metal casting with the predetermined quantity of the solid particles dispersed therein; and moving the moving half of the die away from the fixed half to eject said casting from the cavity.

The cartridge is preferably sealed with foil at both ends. Also it is preferably made of the same metal as the metal being used for die-casting; in this manner it can be recycled by re-melting it after ejection of the metal casting from the cavity. In fact in a hot-chamber die-casting system, when the cartridge is made of the same metal, it may readily be produced by die-casting in the bore of the sprue bushing, thus achieving a tight fit of said cartridge within said bore. This may be done by using a suitable sprue post fitted on the moving half of the die and centred to the centerline of the bore of the sprue bushing. In this manner a cartridge is produced which has a hollow frustoconical shape fitting tightly within the bore of the sprue bushing and having the length essentially corresponding to the length of said bore. This method of producing the cartridge is, however, by no means limitative and the cartridge may be manufactured in any desired manner.

Once the cartridge has been produced, it is filled with the predetermined quantity of solid particles, for example by first sealing one end thereof with foil, such as aluminum foil, then filling the cartridge through the other open end with the predetermined quantity of the solid particles, and finally also sealing the other end of the cartridge with foil. However, if the cartridge is positioned so that it is inclined with reference to the horizontal, it may be sufficient to seal said cartridge only at one end to retain the solid particles within the cartridge by gravity. Moreover, when the cartridge is frustoconical in shape and the amount of solid particles is small, the particles may again congregate to the wide end by gravity, which in such a case must be sealed, without overflowing through the narrow end which may thus be left open. In spite of these possibilities, it is usually more practical to seal the cartridge at both ends after it has been filled with a predetermined quantity of the solid particles. The solid particles may, for example, be ceramic particles and they are preferably preheated in the cartridge prior to being inserted into the runner so as to decrease thermal shock to the particles when they are intermixed with the molten metal.

In a preferred embodiment the molten metal is a diecastable magnesium alloy, such as AM20, AM50, AM60, AS41, AE42 or AZ91. Most of these alloys comprise aluminum as the alloying element and thus when the cartridge is sealed with aluminum foil, this merely adds a small amount of aluminum to the overall metal composition, which is quite acceptable. The foil may be adhered to the cartridge using, for example, a ceramic adhesive. It should further be understood that the term "foil" as used herein refers to any suitable material that may be used to seal the cartridge so long as it can be pierced by the molten metal flowing through the runner where the cartridge is positioned and withstand the preheating temperature if the cartridge is preheated.

In order to prevent the cartridge from penetrating into the cavity and also to achieve good dispersion of the solid particles in the metal casting, it is advisable to provide suitable means, such as a sprue post on the moving half of the die having a design such as to insure that the cartridge will stop at the entrance to the cavity when metal is injected and also that good dispersion will be achieved by properly directing the flow of the molten metal into the cavity, intermixed with the solid particles. The shot of the molten metal is normally performed in a fraction of a second, allowing a very quick and intermixing of the molten metal with the solid particles, while avoiding as much as possible any chemical reaction to take place therebetween. During the die-casting operation, the cartridge will become welded to the casting and will be removed when the casting is ejected from the cavity. The cartridge can then be recycled by re-melting.

BRIEF DESCRIPTION OF THE DRAWINGS

A preferred embodiment of the invention will now be described with reference to the appended drawings, in which.

DESCRIPTION OF THE PREFERRED EMBODIMENT

The preferred embodiment of the invention is illustrated but not limited by the appended drawings where the same reference members are used to describe the same parts in all figures.

Figure 1:
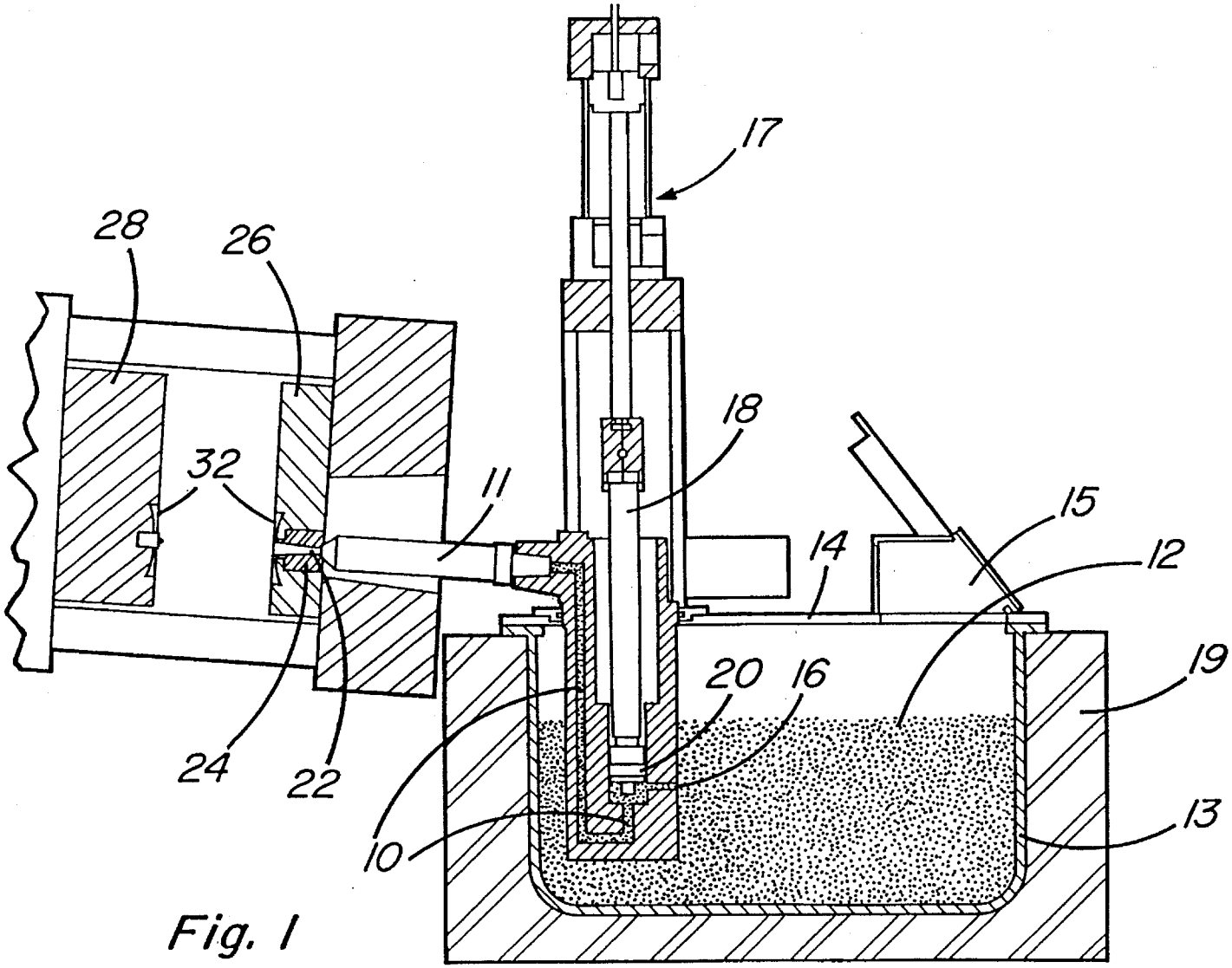
FIG. 1 illustrates a hot-chamber die-casting method and system, partly in section view, used for the purposes of the present invention.

Referring to FIG. 1, it illustrates the hot-chamber die-casting method in which the so-called gooseneck 10 having a nozzle 11 is placed within a molten metal bath 12 contained in a crucible 13 closed at the top by roof 14 and into which molten metal may be charged through mouth 15. Crucible 13 is placed within a refractory lining 19 as is well known in the art. The molten metal penetrates into the gooseneck 10 through feed holes 16. Plunger 18 with piston 20 is used to inject the molten metal 12 through the nozzle 11 into the runner or bore 22 of the sprue bushing 24 provided in the fixed half 26 of the die which also has a moving half 28. The cavity 32 in which the part is die-cast is formed between the fixed half 26 and the moving half 28 of the die.

When plunger 18 is pushed downwards by hydraulic system 17, the molten metal 12, for example a diecastable magnesium alloy, is injected through nozzle 11 and bore 22 into the cavity 32 when the two halves 26, 28 of the die are pressed against each other, where it is allowed to solidify thus forming the desired casting. There is usually one casting produced per shot of the molten metal. When the casting has solidified within cavity 32, the moving half 28 of the die is moved away from the fixed half 26 as shown in FIG. 1 and the die-cast part is ejected from the cavity.

Figure 2:
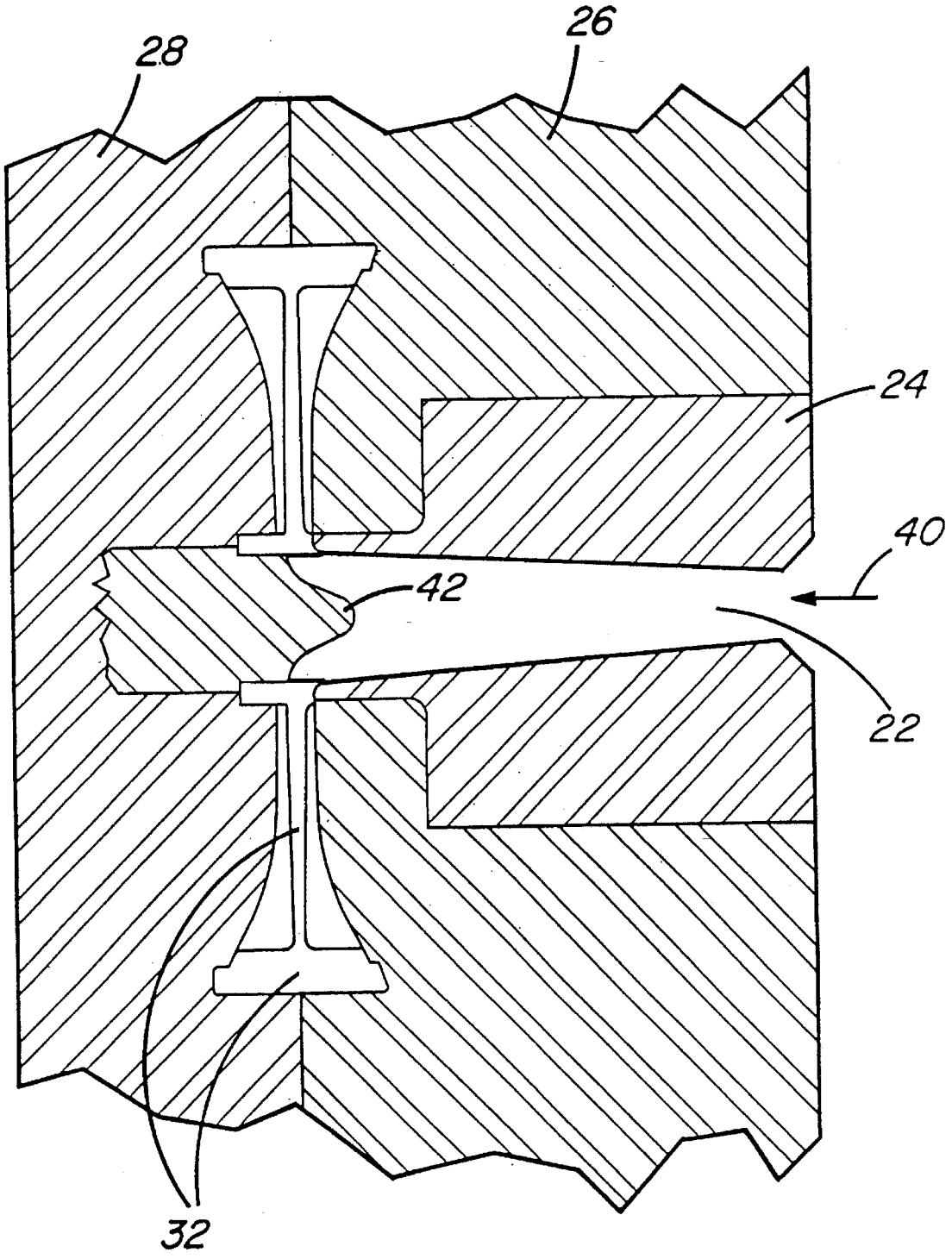
FIG. 2 is an enlarged, partly sectional, side view of the sprue brushing or runner arrangement also showing the sprue post and the die cavity into which the molten metal is injected.

FIG. 2 illustrates in an enlarged section view, the cavity formed between the two halves of the die in closed position also showing the runner leading to the cavity. The molten metal is injected through bore 22 of the sprue bushing 24 in the fixed half 26 of the die, as shown by arrow 40. The metal flows around the sprue post 42, which is provided on the moving half 28 of the die, and into the cavity 32 located between the fixed half 26 and the moving half 28 of the die.

Figure 3:
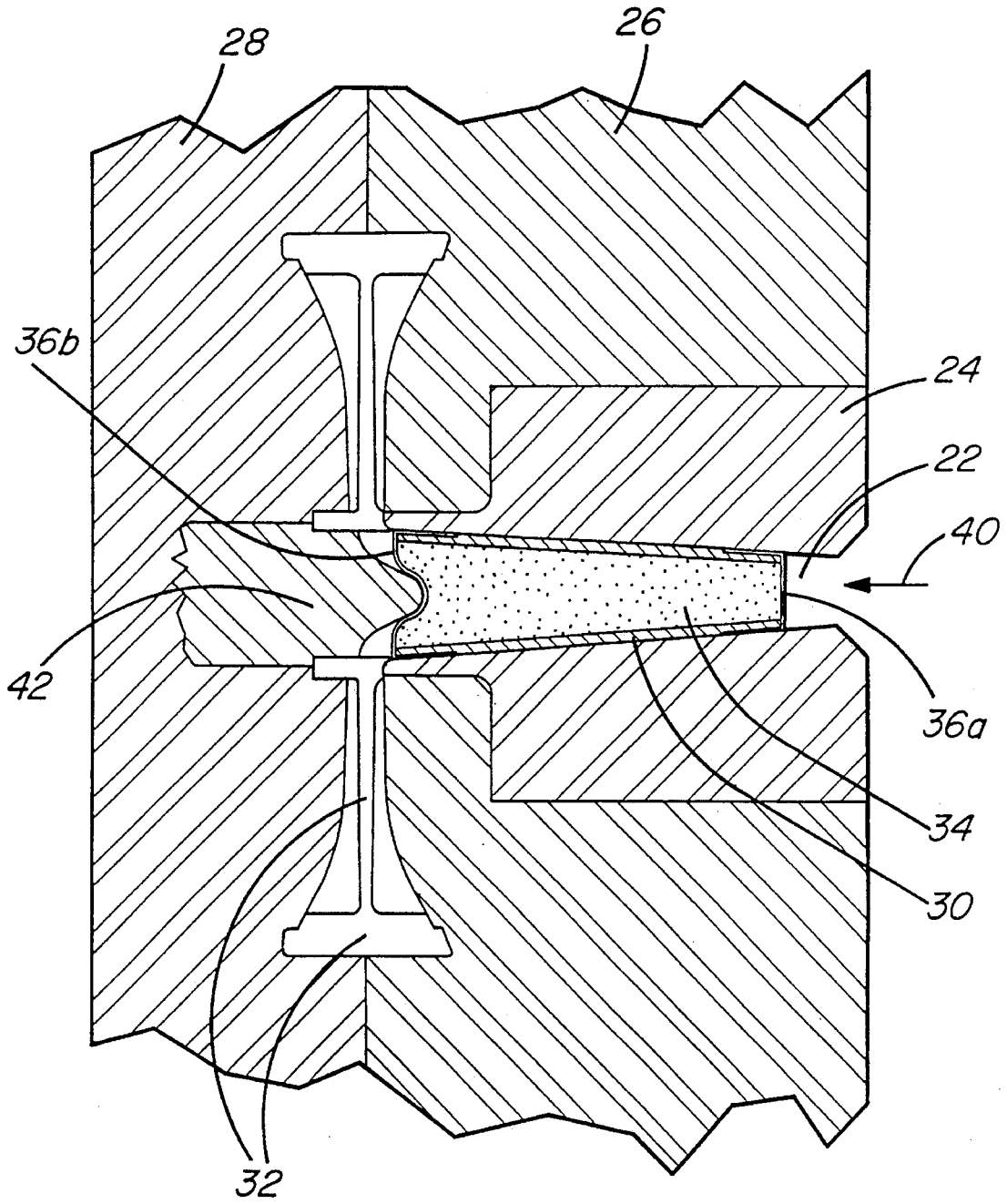
FIG. 3 is the same view as in FIG. 2, but in addition showing the position of the cartridge with solid particles used in accordance with the present invention.

FIG. 3 is similar to FIG. 2, however, it further shows the provision, in accordance with the present invention, of a cartridge 30, which can be made of the same metal 12, in the bore 22 of the sprue bushing 24 in the fixed half 26 of the die. Cartridge 30 which may, for example, be 1.5 mm thick, contains therein a predetermined amount of solid particles 34 and is sealed at each end with foil 36A and 36B which can be glued to the cartridge 30 by means of a ceramic adhesive. When molten metal 12 is injected as shown by arrow 40 in FIG. 3, it pierces foil 36A and flows through the cartridge 30 in bore 22. The metal intermixes with the solid particles 34 in the cartridge 30 as it flows through said cartridge and also pierces foil 36B at the other end of the cartridge 30 and with the solid particles 34 being dispersed in the molten metal 12, the combination enters cavity 32 flowing around sprue post 42 located on the moving part 28 of the die. When the front end of the sprue post 42 pushes against the foil 36B, the latter conforms to the shape of the sprue post. The metal shot through the cartridge 30 is normally effected very rapidly, for example in less than a second, and this allows the molten metal 12 to intermix very well with the particles 46 and fill the cavity 32 so rapidly that there is essentially no time for any reaction to take place between the metal 12 and the particles 34. In this regard, it should be noted that in distinction to the known prior art, the cartridge 30 with the solid particles 34, is located, in accordance with the present invention, right at the entrance to the cavity 32 in the runner or bore 22 and this allows a very rapid intermixing of the solid particles 34 with the molten metal 12 followed by an almost immediate penetration into the die cavity 32 where the combination of metal 12 and solid particles 34 dispersed therein is solidified to form the die-cast part.

The incoming liquid metal injected in the direction shown by arrow 40 may, for example, be a magnesium alloy such as AZ91 which has an aluminum content of 8.5–9.5%. The temperature of such molten alloy will be 610°–650° C. and to decrease the thermal shock between the liquid metal 12 at this temperature and the solid particles 34, that may damage these solid particles, it is preferable to preheat the cartridge 30 and the solid particles 34 contained therein to a temperature of 250° C.–350° C. or even higher. The foil 36A and 36B which seals the cartridge 30 at both ends is normally aluminum foil and it becomes part of the molten metal flowing into the cavity 32. This, however, will not significantly increase the aluminum content of the die-casting alloy.

Figure 4:
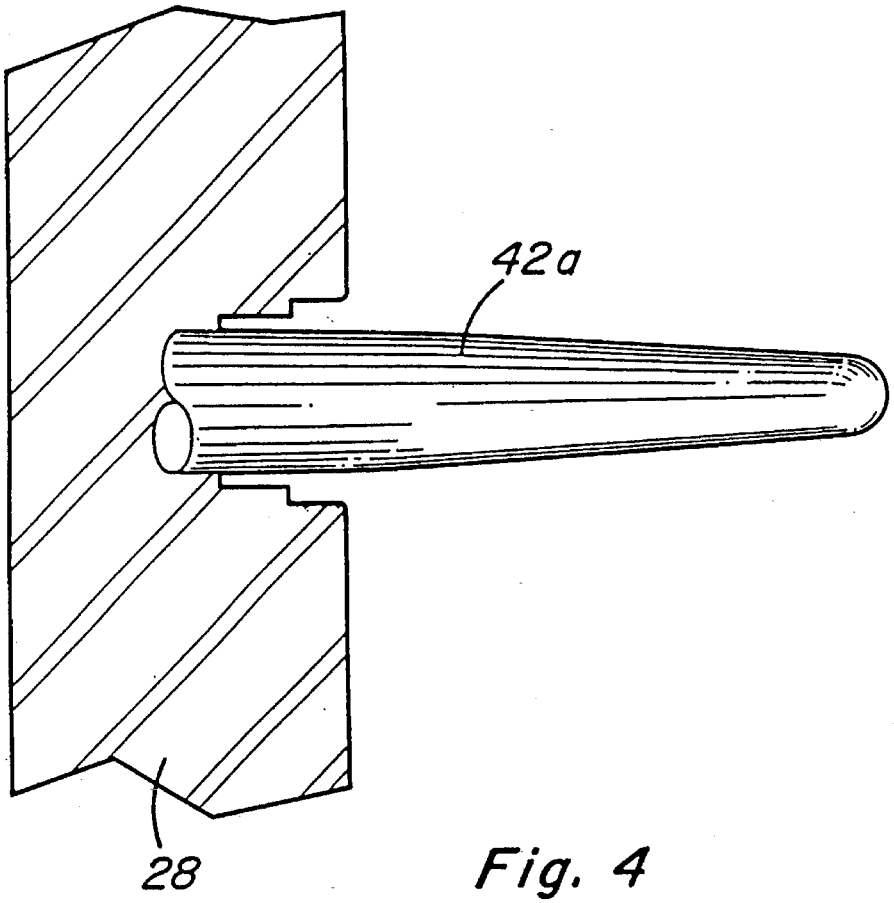
FIG. 4 illustrates a sprue post used for die-casting the cartridge shown in FIG. 3.

Cartridge 30 can be easily fabricated by die-casting directly in bore 22 of the sprue bushing 24. This can be achieved by providing the moving half 28 of the die with a suitable sprue post 42A as shown in FIG. 4. This sprue post is centred to the centerline of the bore 22 of the sprue bushing 24 and penetrates into said bore tightly, leaving a space around it corresponding to the eventual thickness of the cartridge (e.g. 1.5 mm). The molten metal 12 is then injected into the bore 22 in the usual manner and allowed to solidify to form said cartridge 30. The cartridge 30 is then removed from bore 22, sealed at one end, for example with aluminum foil 36A and filled with a predetermined and precisely measured quantity of particles 34. It is then sealed at the other end with aluminum foil 36B, for instance using a ceramic adhesive, preheated to 250° C.–350° C. and re-inserted into bore 22 of sprue bushing 24 prior to the shot of molten metal 12 being injected in the direction of arrow 40 as shown in FIG. 3.

Figure 5:
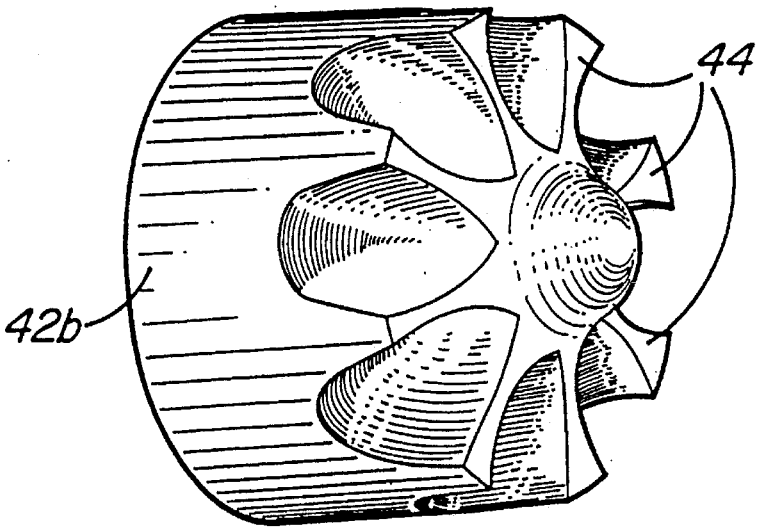
FIG. 5 illustrates a sprue post used for die-casting a part according to the present invention.

When the molten metal 12 is injected through cartridge 30, it intermixes with particles 34 and then flows into cavity 32 around the sprue post 42 provided on the moving half 28 of the die. This sprue post 42 is different from the sprue post 42A and is made such as to prevent cartridge 30 from penetrating into the cavity 32 and also to enhance intermixing of the solid particles within the molten metal as it flows in the various areas of the cavity 32. For example, a sprue post 42B shown in FIG. 5 would be suitable for such purpose as it is provided with side projections 44 onto which the front edge of the cartridge 30 will abut and which thereby will prevent the cartridge from advancing into cavity 32 and thereby blocking the flow of the molten metal.

Other similar geometries of the sprue post, that would prevent penetration of the cartridge into the cavity and also possibly enhance dispersion of the solid particles in the molten metal may, of course, be provided, depending on the shape of the final part to be die-cast in the cavity 32.

Figure 6:
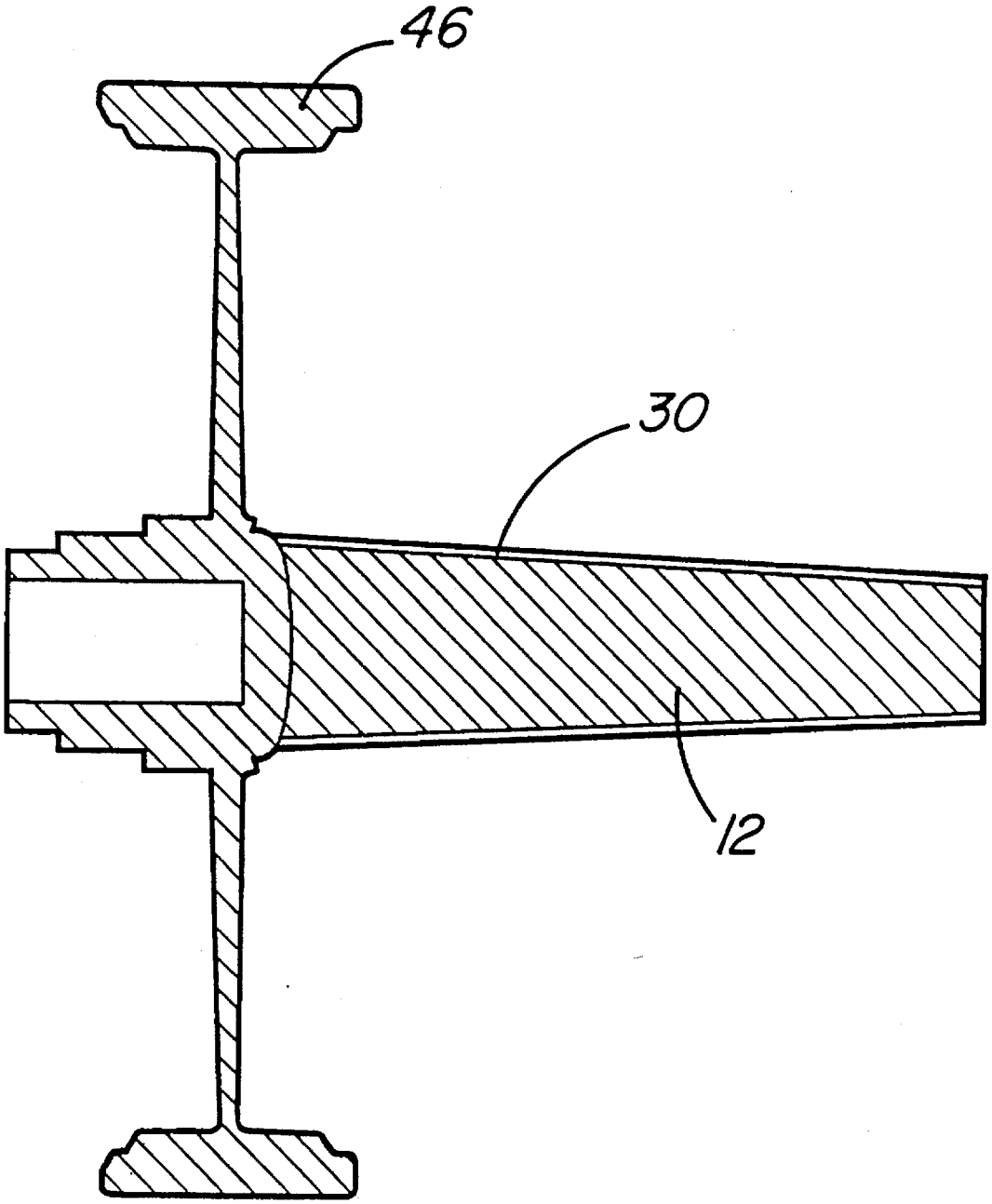
FIG. 6 is a sectional side view of the die-cast part, produced in accordance with this invention and having the cartridge still attached thereto.

An example of a part, die-cast in accordance with the present invention is shown in elevation-section view in FIG. 6. It was made of AZ91 alloy and had an excellent dispersion of ceramic particles therein, which enhanced substantially its properties. The composite material of part 46 contained exactly 10% of ceramic particles dispersed therein with good uniformity. A stiffer and more wear resistant part 46 was thus obtained as compared to the same part made solely of the magnesium alloy.

When the die-cast part 46 is removed from the die, the cartridge 30 stays welded (melted) to the casting and is carried out when the part is ejected. Cartridge 30 is filled with metal 12 which has solidified therein after the shot is completed. It is then broken off or cut off from the casting 46 and can be re-cycled. It is for this reason that it is particularly suitable to use the same metal for the cartridge 30, in accordance with the present invention, as is used for the casting 46.

It should be understood that the invention is not limited to the specific embodiment described above, but that many modifications obvious to those skilled in the art can be made. For example, the preferred embodiment has been described with reference to a hot-chamber die-casting method which is characterized by placing the metal supply chamber into the metal bath. However, it could also be used with a cold-chamber die-casting method where the liquid metal is poured into the shot sleeve and then shot through the runner into the cavity. Also, in accordance to the present invention, any type of solid particles that will produce the desired improved characteristics in the die-cast part can be used. As is known in the art, such particles may be ceramic particles, metallic powder, sand and the like. Moreover, the quantity of the particles will only be limited by the desired effect that they produce in the casting and by the size of the cartridge where they are placed prior to be injected into the cavity with the molten metal. Normally, when ceramic particles are used, up to 20% of such particles may be dispersed within the composite material from which the casting is formed. Furthermore, many various forms and shapes may be die-cast in accordance with the present invention that require composite materials for an improved application; such castings can be used in many areas, such as automotive parts, engineering components and the like.

Thus, the present invention should be interpreted broadly, having regard to the following claims.

We claim:

1. A method of die-casting of metals, with dispersion of predetermined quantities of solid particles in resulting metal castings, said metal castings being made by injection of a diecastable molten metal into a cavity formed between two halves of a die, a fixed half and a moving half, the injection of the molten metal into said cavity being effected through a runner leading into the cavity, said method comprising: inserting into said runner a cartridge containing a predetermined quantity of solid particles to be dispersed in a metal casting, said cartridge being sealed with foil at least at one end thereof so as to retain the solid particles within the cartridge; injecting a shot of the molten metal into the cavity through said cartridge, thereby piercing the foil sealing said cartridge and entraining the solid particles contained in said cartridge into the cavity while intermixing said particles with said molten metal; allowing said molten metal to solidify in the cavity to form the metal casting with the predetermined quantity of the solid particles dispersed therein; and moving the moving half of the die away from the fixed half to eject said casting from the cavity.

2. Method according to claim 1, wherein the cartridge is made of the same metal as the metal being used for die-casting.

3. Method according to claim 1, wherein the molten metal is a diecastable magnesium alloy.

4. Method according to claim 3, wherein said magnesium alloy is selected from the group consisting of AM20, AM50, AM60, AS41, AE42 and AZ91.

5. Method according to claim 1, wherein the cartridge is sealed with foil at both ends thereof.

6. Method according to claim 1, wherein the foil sealing the cartridge is aluminum foil.

7. Method according to claim 1, wherein the shot of the molten metal through the cartridge is performed in a fraction of a second.

8. Method according to claim 1, wherein the shot of the molten metal through the cartridge is performed in such a manner as to prevent the cartridge itself from entering the cavity.

9. Method according to claim 8, wherein the cartridge is welded to the casting during the die-casting operation and is carried out when the casting is ejected from the cavity.

10. Method according to claim 1, wherein the cartridge and the solid particles contained therein are preheated prior to being inserted into the runner so as to decrease thermal shock to the particles when they are intermixed with the molten metal.

11. A method of hot-chamber die-casting of metals, with dispersion of predetermined quantities of solid particles in resulting metal castings, said metal castings being made by injection of a diecastable molten metal into a cavity formed between two halves of a die, a fixed half and a moving half, the injection of the .molten metal into said cavity being effected through a bore of a sprue bushing mounted in the fixed half of the die, said method comprising: inserting into said bore a cartridge containing a predetermined quantity of solid particles to be dispersed in a metal casting, said cartridge being sealed with foil at least at one end thereof so as to retain the solid particles within the cartridge; injecting a shot of the molten metal into the cavity through said cartridge, thereby piercing the foil sealing said cartridge and entraining the solid particles contained in said cartridge into the cavity while intermixing said particles with said molten metal; allowing said molten metal to solidify in the cavity to form the metal casting with the predetermined quantity of the solid particles dispersed therein; and moving the moving half of the die away from the fixed half to eject said casting from the cavity.

12. Method according to claim 11, wherein the cartridge is made of the same metal as the metal being used for die-casting.

13. Method according to claim 12, wherein the cartridge is produced by die-casting said cartridge in the bore of the sprue bushing so as to achieve a tight fit of said cartridge within said bore.

14. Method according to claim 13, wherein the cartridge is die-cast using a suitable sprue post fitted on the moving half of the die and centred to the centerline of the bore of the sprue bushing.

15. Method according to claim 11, wherein the cartridge has a hollow frustoconical shape fitting tightly within the bore of the sprue bushing and has the length essentially corresponding to the length of said bore.

16. Method according to claim 11, wherein the cartridge is sealed with foil at both ends thereof.

17. Method according to claim 11, wherein the cartridge and the solid particles contained therein are preheated prior to being inserted into the bore so as to decrease thermal shock to the particles when they are intermixed with the molten metal.

18. Method according to claim 11, wherein the solid particles are ceramic particles.

19. Method according to claim 18, wherein the ceramic particles are added in an amount of up to 20% of the metal casting.

20. Method according to claim 11, wherein the molten metal is a diecastable magnesium alloy.

21. Method according to claim 20, wherein said alloy is selected from the group consisting of AM20, AM50, AM60, AS41, AE42 AND AZ91.

22. Method according to claim 11, wherein the foil sealing the cartridge is aluminum foil.

23. Method according to claim 11, wherein during the injection of the molten metal which is intermixed with the solid particles, a sprue post is provided on the moving half of the die having a design such as to prevent the cartridge from entering the cavity and insure good dispersion of the solid particles in the metal casting.

24. Method according to claim 11, wherein the shot of the molten metal through the cartridge is performed in a fraction of a second.

25. Method according to claim 11, wherein the cartridge is welded to the casting during the die-casting operation and is carried out when the casting is ejected from the cavity.

* * * * *